United States Patent [19]

Britzman

[11] 4,236,264

[45] Dec. 2, 1980

[54] RETAINED COMPRESSIBLE PILLOW SUPPORT

[76] Inventor: Agnita Britzman, 1015 E. Fourth St., Long Beach, Calif. 90802

[21] Appl. No.: 831,969

[22] Filed: Sep. 9, 1977

[51] Int. Cl.[3] ..... A47G 9/00; B63C 9/16

[52] U.S. Cl. ..... 5/435; 5/441; 9/345; 297/393

[58] Field of Search ..... 5/434, 436, 437, 440, 5/441, 446, 447, 490, 431, 443; D6/201, 202, 203, 204; 9/337, 340, 345; 128/68; 297/393

[56] References Cited

U.S. PATENT DOCUMENTS

| | | | |
|---|---|---|---|
| 1,487,923 | 3/1924 | De Vilbiss | 9/345 |
| 2,336,707 | 12/1943 | Thompson | 5/338 |
| 3,009,175 | 11/1961 | Marston | 9/340 |

FOREIGN PATENT DOCUMENTS

| | | | |
|---|---|---|---|
| 467637 | 12/1951 | Italy | 297/393 |
| 771575 | 4/1957 | United Kingdom | 9/340 |

*Primary Examiner*—Roy D. Frazier
*Assistant Examiner*—Alexander Grosz
*Attorney, Agent, or Firm*—Fulwider, Patton, Rieber, Lee & Utecht

[57] ABSTRACT

There is disclosed a generally horseshoe shaped pillow support including a closed tubular flexible envelope in the shape of a horseshoe and including a horseshoe return having a pair of transversely spaced apart legs projecting co-extensively forwardly from such return. The tubular envelope may be in the form of a thin walled plastic sheet for inflation thereof by air, and the back wall of the return cooperates with the front wall thereof upon inflation of the envelope to cause free extremities of the legs to swing inwardly toward one another to normally be in contact with one another at the free extremities.

12 Claims, 5 Drawing Figures

RETAINED COMPRESSIBLE PILLOW SUPPORT

BACKGROUND OF THE INVENTION

1. Field of the Invention

The present invention relates to a pillow support which may be conveniently fitted about a person's extremity, such as neck or arm and will encompass and be retained on such extremity.

2. Description of the Prior Art

Numerous different types of pillow and support type structures have been proposed for supporting a person's head while traveling in a vehicle or for elevating a person's head while sleeping. Some of these proposed supports have been of somewhat horseshoe shape but are generally inflexible and assume a nearly permanent horseshoe shape having generally rigid spaced apart legs held in position by incompressible filler in the pillow itself. These devices fail to fit comfortably about a person's extremity while gripping such extremity and being comfortably retained thereon.

SUMMARY OF THE INVENTION

The retained compressible pillow support of the present invention is characterized by a flexible horseshoe shaped tubular closed envelope having generally coextensive legs projecting from the envelope return and constructed to have their free extremities urged inwardly toward one another upon filling of the envelope with a compressible filler such that the legs will be urged toward one another to grip the opposite sides of a person's extremity on which the support is applied.

DETAILED DESCRIPTION OF THE PREFERRED EMBODIMENT

Figure 1:
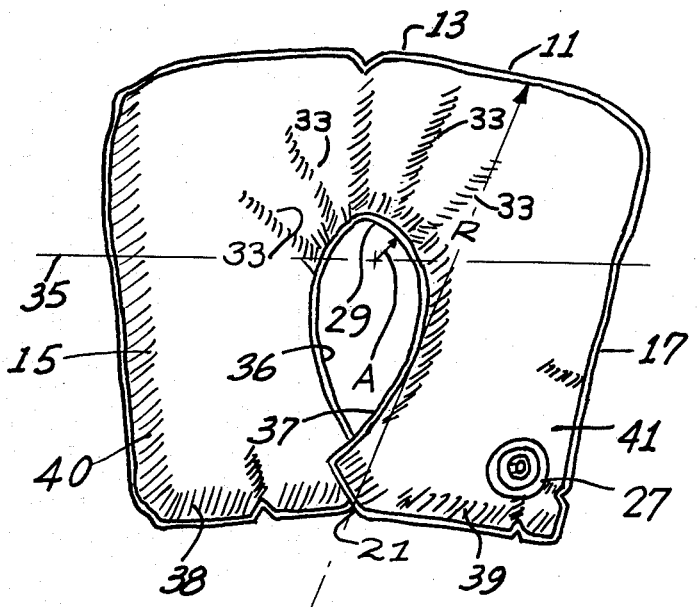
FIG. 1 is a top plan view of an inflated retained compressible pillow support embodying the present inventions.
Figure 4:
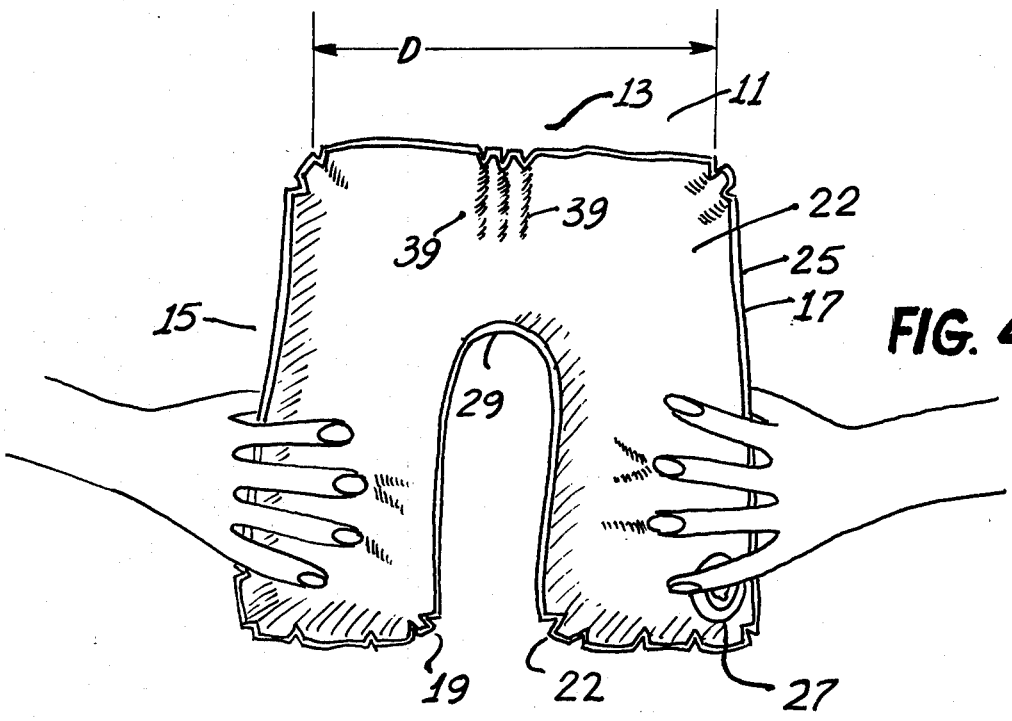
FIG. 4 is a top plan view, in enlarged scale, of the pillow support shown in FIG. 1 but with the legs thereof spread apart.
Figure 5:
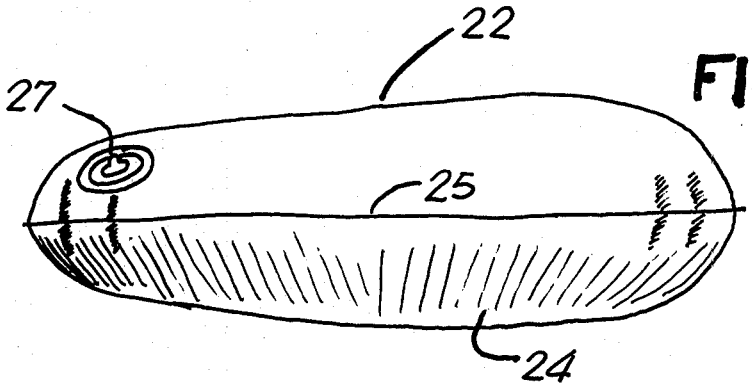
FIG. 5 is a side view, in enlarged scale, of the pillow support shown in FIG. 1.

Referring to FIG. 1, the retained compressible pillow support of the present invention includes a hollow, thin walled tubular envelope 11 including a back return 13 having a pair of generally coextensive legs 15 and 17 projecting forwardly therefrom and angling inwardly toward one another to normally be in contact with one another at the insides contact surfaces 19 and 21. Thus, the free extremities of the legs 15 and 17 may be spread apart as shown in FIG. 4 for receipt of a person's neck or arm therebetween and the legs then released to be urged inwardly toward one another under their inherent bias thus gripping the opposite sides of such neck or arm to hold the pillow support firmly retained thereon.

Heretofore, various shaped supports have been proposed for elevating a person's head or various extremities but such supports have been of generally a passive nature in that they tend to cradle the extremity without exhibiting any tendency to actually grip the extremity and be securely retained thereon. To this end, the compressible pillow support of the present invention is configured to inherently grip an extremity to which it is applied.

In the preferred embodiment, the envelope 11 is constructed of a pair of substantially identically horseshoe shaped 0.020 inches thick vinyl sheets 22 and 24 which overlie one another and are sealed together about their entire peripheries to form a continuous peripheral heat seal 25 (FIG. 3) thus providing a closed envelope.

Figure 2:
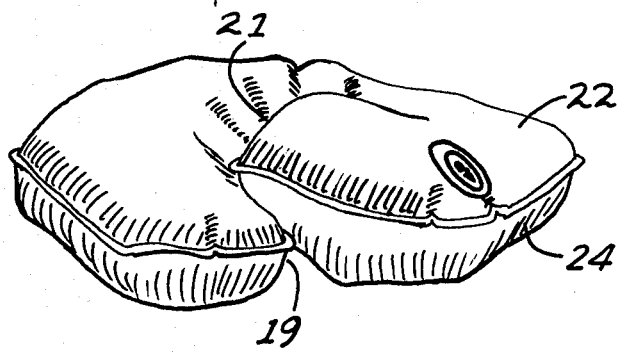
FIG. 2 is a front view of the pillow support shown in FIG. 1.

Referring to FIG. 2, the upper and lower sheets 22 and 24 are generally horseshoe shaped construction and with reference to FIG. 1 are formed on the front sides of the return 13 with a 29 curved yoke defining a semicircle forward of the vertical plane indicated by the line 35 having a radius r of about one inch. The sheets project parallel forwardly from the opposite sides of such yoke to form interior leg walls 36 and 37 and curve outwardly at their free extremities to cooperate in forming the contact surfaces 19 and 21. Such sheets then project outwardly in opposite directions to form transverse free end walls 38 and 39 of the legs 15 and 17 respectively and then curve rearwardly forming parallel opposed exterior side walls 40 and 41 and then turn inwardly toward one another to extend along the back side of the return forming the back wall 13. The legs 15 and 17 are of substantially uniform width W throughout their lengths from the yoke 29 to the free end walls 38 and 39.

A conventional air valve, generally designated 27, is incorporated in one of the horseshoe shaped vinyl sheets at the free extremity of one of the legs 17 for convenient inflation of the envelope 11.

In use the envelope 11 may be inflated through the valve 27 and the top and bottom sheets 22 and 24 will distend upwardly and downwardly, respectively, from one another and the back wall of the return 13 will be maintained transversely extended. Concurrently, the back wall 13 and front turnback wall will be maintained distended to be spaced apart forwardly and rearwardly, it being appreciated that the semicircular yoke will tend to maintain its original one inch radius. This results in puckers 33 radiating outwardly from the yoke 29 in both the upper and lower walls 22 and 24.

Figure 3:
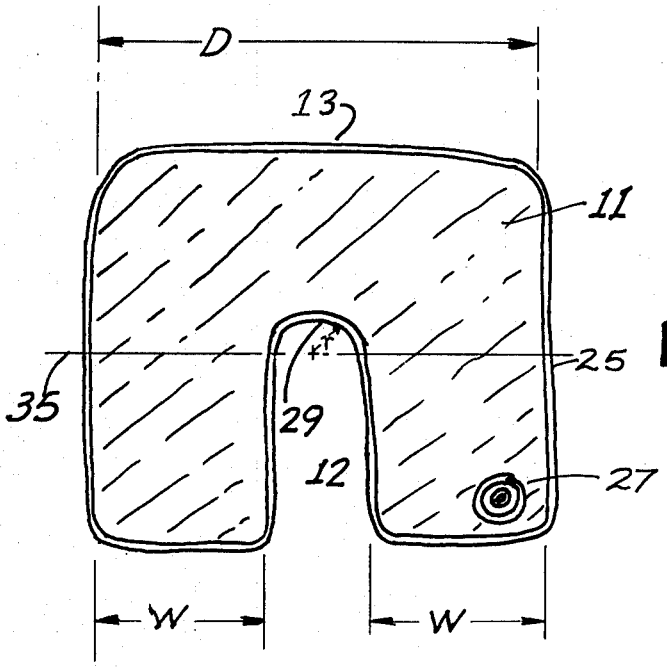
FIG. 3 is a top plan view of the pillow support shown in FIG. 1 but with such support being deflated.

The wall of the yoke 29 thus limits the quantity of envelope material available for distension while the linear back wall 13 exhibits a proportionately greater amount of envelope material for distension in the transverse direction thus resulting in such back wall distending relatively freely laterally outwardly while the restricted quantity of envelope material about the yoke 29 will cause the intermediate portion of the legs 15 and 17 to be drawn transversely inwardly toward one another. This action tends to rotate the legs 15 and 17 to swing the free extremities toward one another to an increasing degree as inflation of the envelope 11 is continued thus causing the contact surfaces 19 and 21 to engate one another. It will be appreciated that this characteristic in the legs 15 and 17 will be experienced to some degree whenever the radius of curvature for the back wall measured in a horizontal plane and indicated at R in FIG. 1, the return 13 is greater than the radius of r for the yoke 29 forming the front wall of such return indicated at r in FIG. 1. In the preferred embodiment the back wall of such return as indicated by the transverse dimension line D in FIGS. 3 and 4, is linear in the transverse direction and cooperates ideally with the yoke 29 of one inch radius. In the fully inflated position condition, there will even be a certain amount of overlap of the interior surfaces of such free extremities of the legs 15 and 17 causing the contact surfaces 19 and 21 to overlap one another. When inflated, the inner walls 36 and 37 of the legs 15 and 17, together with the yoke 29, define an oblong aperture extending longitudinally with the legs 15 and 17, as illustrated in FIG. 1. This longitudinal aperture has a maximum width equal to the width of the yoke 29, which is a distance 2r as measured horizontally along the plane 35 in FIG. 1.

While the pillow support of the present invention may take many different forms, the support disclosed in the preferred embodiment as constructed to utilize air as a compressible filler for the envelope 11. The particular envelope formed to provide the most convenient support is constructed to have distended dimensions having a maximum transverse dimension D of about 16 inches, length from the back wall of the return 13 to the front extremities of the legs 15 and 17 of about 15½ inches and leg width of about 6 inches.

In the particular embodiment shown, the forward extremities of the legs 15 and 17, when inflated, are slightly reduced in vertical cross section over that of the return 13 thus providing a vertical depth of five inches in the middle of the return 13 and a vertical depth of 4½ inches at the front extremities of the legs 15 and 17 just as the top and bottom walls thereof break away to curve rapidly inwardly toward one another.

In operation, when it is desirable to utilize the retaining compressible pillow support of the present invention to support one's head, as for instance, face up on a sun deck, the free extremities of the legs 15 and 17 may be grasped on their opposite outer sides as shown in FIG. 4 and the legs drawn apart thus partially collapsing the back wall of the return 13 in the transverse direction and developing collapsing puckers 39 therein while expanding the interior puckers 33 radiating outwardly from the yoke 29. The legs 15 and 17 may then be fitted around the opposite sides of the sun bather's neck and such legs released thus permitting the inherent tendency of the back wall of return 13 to distend transversely and causing the free extremities of the legs 15 and 17 to be urged inwardly toward one another thus gripping the opposite sides of such neck and retaining the pillow thereon. The sun bather will then have a feeling of secure positioning on the pillow and elevating his head for the desired inclination depending on the position of the sun or for reading or otherwise observing the surrounding scenery.

It will be appreciated that the subject retained compressible pillow support will have many uses such as supporting a user's head face down overhanging one end of a chaise lounge with his chin cradled in the turnback 29 and the legs 15 and 17 extending along the opposite sides of his face to provide support thereto while leaving his line of sight unobstructed so he can read a book positioned on the ground below his head. Such support can also be utilized to maintain the head elevated while floating in the pool, may be used as a cushion to sit on, or a pillow to sleep on, as well as numerous other uses.

When use of the support pillow has been completed, the valve 27 may conveniently be opened, and the pillow rapidly be deflated and folded to form a compact package for storing in the user's purse or beach bag. The pillow will then readily be available for subsequent use at future times and different places.

Various modifications and changes may be made with regard to the foregoing detailed description without departing from the spirit of the invention.

I claim:

1. A retained compressible pillow support comprising:

a flexible closed tubular envelope, generally horseshoe shaped, and formed with a return including a transversely extending flexible back wall and a flexible curved front wall defining a yoke, said envelope being formed with hollow transversely spaced apart legs projecting forwardly from opposite sides of said yoke, the free extremities of said legs being spaced apart from each other when the pillow support is unfilled, and having respective inner walls connected to said yoke and extending longitudinally to transverse free end walls, and having outer walls leading from the transverse outer ends of said back wall, to said free end walls, said legs being of substantially uniform width from said yoke to said free end walls, said envelope being further formed such that upon being filled with a compressible filler, the tubular walls thereof will be distended causing said back wall to distend transversely while said yoke restricts transverse distension at the front of said return, thus causing said front wall to draw the forward extremitites of said legs to urge them inwardly toward one another to define, together with said yoke, an oblong aperture extending longitudinally between said legs and having a maximum width equal to the width of said yoke, whereby in use said legs may be grasped and the forward extremities thereof drawn apart for receipt of a user's extremity therebetween, and upon release of said legs, said front wall at said yoke cooperates with said back wall and filler to urge the free extremities of said legs inwardly into mutual engagement.

2. A retained compressible pillow support as set forth in claim 1 wherein:

said envelope is constructed of thin plastic sheet and includes valve means for inflating said envelope with an air filler.

3. A retained compressible pillow support as set forth in claim 1 wherein:

said legs are spaced apart substantially two inches at said yoke.

4. A retained compressible pillow support as set forth in claim 1 wherein:

said legs project forwardly from said return and upon being filled with said filler curve inwardly toward one another at the free extremities thereof.

5. A retained compressible pillow support as set forth in claim 1 wherein:

said envelope, when filled, is substantially five inches deep along said return and tapers inwardly on its top and bottom sides to a depth of substantially 4½ inches at the free extremities of said legs.

6. A retained compressible pillow support as set forth in claim 1 that includes:

a compressible filler filling said envelope.

7. A retained compressible pillow support as set forth in claim 1 wherein:

said envelope is constructed of a pair of substantially identical horseshoe shaped sheets which overlie one another and are sealed together about their entire perpheries to form a continuous peripheral seal.

8. A retained compressible pillow support as set forth in claim 1 that includes:

air filling said envelope.

9. A retainer compressible pillow support as set forth in claim 1 wherein:

said front wall is formed to define a semicircular yoke having a radius substantially one inch.

10. A retained compressible pillow support as set forth in claim 1 wherein:

said envelope is formed to, when filled, have a back wall transverse length of substantially 16 inches and to form said yoke with a radius of one inch.

11. A retained compressible pillow support as set forth in claim 1 wherein:

said yoke is curved and said back wall of said return has a radius of curvature greater than that of said yoke.

12. A retained compressible pillow support as set forth in claim 1 wherein:

said yoke is curved to have a radius of substantially one inch and said back wall is substantially linear in the transverse direction.

* * * * *